US007819107B2

(12) United States Patent
Stockner et al.

(10) Patent No.: US 7,819,107 B2
(45) Date of Patent: Oct. 26, 2010

(54) PUMPING ELEMENT FOR A FLUID PUMP AND METHOD

(75) Inventors: Alan R. Stockner, Metamora, IL (US); Scott F. Shafer, Morton, IL (US)

(73) Assignee: Caterpillar Inc, Peoria, IL (US)

( * ) Notice: Subject to any disclaimer, the term of this patent is extended or adjusted under 35 U.S.C. 154(b) by 123 days.

(21) Appl. No.: 12/338,335

(22) Filed: Dec. 18, 2008

(65) Prior Publication Data

US 2009/0159053 A1 Jun. 25, 2009

Related U.S. Application Data

(60) Provisional application No. 61/016,130, filed on Dec. 21, 2007.

(51) Int. Cl.
*F02M 33/04* (2006.01)

(52) U.S. Cl. ..... 123/445; 417/494; 92/163

(58) Field of Classification Search ..... 123/445, 123/446, 447; 417/493, 494; 92/153–160
See application file for complete search history.

(56) References Cited

U.S. PATENT DOCUMENTS

| | | | | | |
|---|---|---|---|---|---|
| 3,695,235 | A | | 10/1972 | Anderson | |
| 3,913,546 | A | * | 10/1975 | Clouse | 123/501 |
| 3,942,914 | A | | 3/1976 | Hofer et al. | |
| 4,222,717 | A | * | 9/1980 | Clouse et al. | 417/499 |
| 4,476,835 | A | | 10/1984 | Laufer | |
| 4,583,508 | A | * | 4/1986 | Schechter | 123/449 |
| 4,585,171 | A | | 4/1986 | Schmidt et al. | |
| 4,625,700 | A | | 12/1986 | Elsbett et al. | |
| 4,813,600 | A | | 3/1989 | Shultz et al. | |
| 4,887,955 | A | * | 12/1989 | Maruyama et al. | 417/501 |
| 5,392,749 | A | | 2/1995 | Stockner et al. | |
| 5,517,972 | A | | 5/1996 | Stockner | |
| 5,740,782 | A | | 4/1998 | Lowi, Jr. | |
| 5,775,203 | A | * | 7/1998 | Osborn et al. | 92/128 |
| 6,192,864 | B1 | * | 2/2001 | Nishimura | 123/458 |
| 6,260,776 | B1 | | 7/2001 | Popp | |
| 6,295,971 | B1 | * | 10/2001 | Peters et al. | 123/495 |
| 6,314,943 | B1 | | 11/2001 | Burch et al. | |
| 6,588,102 | B1 | | 7/2003 | Perry et al. | |
| 6,805,105 | B2 | * | 10/2004 | Kato et al. | 123/514 |
| 7,021,558 | B2 | | 4/2006 | Chenanda et al. | |
| 7,028,918 | B2 | | 4/2006 | Buchanan et al. | |
| 7,261,246 | B2 | | 8/2007 | Krause et al. | |
| 2005/0145726 | A1 | | 7/2005 | Dick et al. | |
| 2010/0043760 | A1 | * | 2/2010 | Crofts et al. | 123/541 |

* cited by examiner

*Primary Examiner*—Thomas N Moulis
(74) *Attorney, Agent, or Firm*—Leydig, Voit & Mayer

(57) ABSTRACT

A pumping element for pressurizing a fluid within a fluid pump includes a plunger reciprocally disposed within a bore defined in a barrel. The plunger and barrel at least partially define a pressurization chamber into which fluid is pressurized. A flow path is defined between the plunger and the bore, the flow path permitting fluid to pass from the pressurization chamber during pressurization of fluid disposed therein. A collection chamber is formed between the plunger and the bore, the collection chamber being disposed adjacent to the bore and being part of a cooling circuit for the pumping element. A plurality of weep openings is defined in the barrel and is fluidly connected to the collection chamber. A reduced diameter portion of the barrel forms an annular reservoir that receives fluid from the weep openings.

25 Claims, 7 Drawing Sheets

PUMPING ELEMENT FOR A FLUID PUMP AND METHOD

CROSS-REFERENCE TO RELATED APPLICATIONS

This patent application claims the benefit of U.S. Provisional Patent Application No. 61/016,130, filed Dec. 21, 2007, which is incorporated by reference.

TECHNICAL FIELD

This patent disclosure relates generally to reciprocating piston pumps for fluids and, more particularly, to fuel pumps for use with internal combustion engines.

BACKGROUND

Fluid pumps having pumping elements that include a plunger reciprocating within a bore formed in a barrel are known. The plunger's reciprocating motion is typically accomplished with a mechanism that moves the plunger with a rotating cam. Alternatively, the plunger may contact an outer portion of a rotating angled disk or swash-plate to provide a controlled variable displacement.

A fluid pump might include a plurality of plungers that pressurize a flow of fluid, typically oil or fuel, for use in an internal combustion engine. For example, a fuel injector might use the flow of pressurized fluid, from the pump to inject the fuel or to intensify the pressure of the fuel that is injected into the engine.

Modern fuel systems use progressively higher injection pressures for injecting fuel within the engine increase the efficiency of the engine and, potentially, reduce emissions. Nevertheless, issues are presented when attempting to increase the service pressure of a fluid pump. For example, increased service pressure increases the thermal load imparted to the plunger, bore surfaces, and other pump elements. In the past, various material and design limitations have generally limited pump outlet pressures because of such thermal effects experienced by various pumping elements. To address such issues, some pump designs have incorporated larger clearances between the plunger and the barrel of pump, but such clearances can reduce the pumping efficiency of the pump, increase leakage, and potentially increase the temperature of the compressed fuel exiting the pump.

SUMMARY

In one aspect, the disclosure describes various embodiments of a pumping element for pressurizing a fluid within a fluid pump. Each pumping element includes a plunger and a barrel. The plunger is reciprocally disposed within a bore defined in the barrel. The plunger and barrel at least partially define a pressurization chamber into which fluid is pressurized. A flow path is defined between the plunger and the bore, which permits fluid to pass from the pressurization chamber during pressurization of fluid disposed therein. A collection chamber is formed between the plunger and the bore. The collection chamber is disposed adjacent to the bore as part of a cooling circuit for the pumping element. A plurality of weep openings defined in the barrel is fluidly connected to the collection chamber. A reduced diameter portion of the barrel forms an annular reservoir that receives fluid from the weep openings.

In another aspect, the disclosure describes a fuel pump for an internal combustion engine. The fuel pump includes a housing defining an inlet port, a return port, a return passage, an outlet port, a cooling fuel inlet port, and a cooling fuel supply passage. In one embodiment, a barrel is disposed within the housing and defines a bore extending through the barrel and having a centerline. A plunger is at least partially disposed within the bore and arranged for reciprocal motion within the bore. A pressurization cavity is at least partially defined between an end of the plunger and an end portion of the bore. The pressurization cavity is adapted for pressurizing an amount of fuel supplied through the inlet port and provided to the outlet port during the pressurization stroke of the plunger. An annular clearance, defined between an outer surface of the plunger and an inner surface of the bore, is in fluid communication with the pressurization volume and an annular collector defined around the inner surface of the bore, surrounding a portion of the plunger, via at least one weep passage formed in the barrel. The annular reservoir is defined peripherally around the barrel and is disposed in fluid communication with the return port around a reduced portion of the barrel. A material thickness in the reduced portion is less than a material thickness of surrounding portions of the barrel.

In yet another aspect, the disclosure describes a method of operating a reciprocating plunger fluid pump at a high pressure. In one embodiment, the fluid pump includes at least one barrel having a bore extending therethrough, which reciprocally accepts the plunger. The method includes admitting an amount of fluid into a pressurization chamber and pressurizing the fluid. An amount of fluid weeps out of the pressurization chamber along an interface between the plunger and the bore, and is collected into a collection chamber defined in the barrel around a portion of the plunger adjacent to the bore. Fluid from the collection chamber and from an external source is collected into an annular reservoir, which is defined peripherally around a reduced diameter portion of the barrel, such that heat is conducted away from the plunger to closely approximate the temperature of the reduced portion of the barrel more closely with the temperature of the plunger during a transient operating condition of the fluid pump.

DETAILED DESCRIPTION

The present disclosure is applicable to a fluid pump having one or more reciprocating plungers that can pressurize a fluid to levels that were previously unattainable by use of known pumping systems. The embodiments disclosed herein are advantageously suited for implementation in fluid pumps that are capable of prolonged and reliable operation in both transient and steady-state operating conditions. Even though known pump configurations are typically limited to outlet pressures at or below about 1800 bar, the pump configurations disclosed herein are advantageously capable of achieving operating pressures of about 2200 to 3000 bar or higher.

Figure 1:
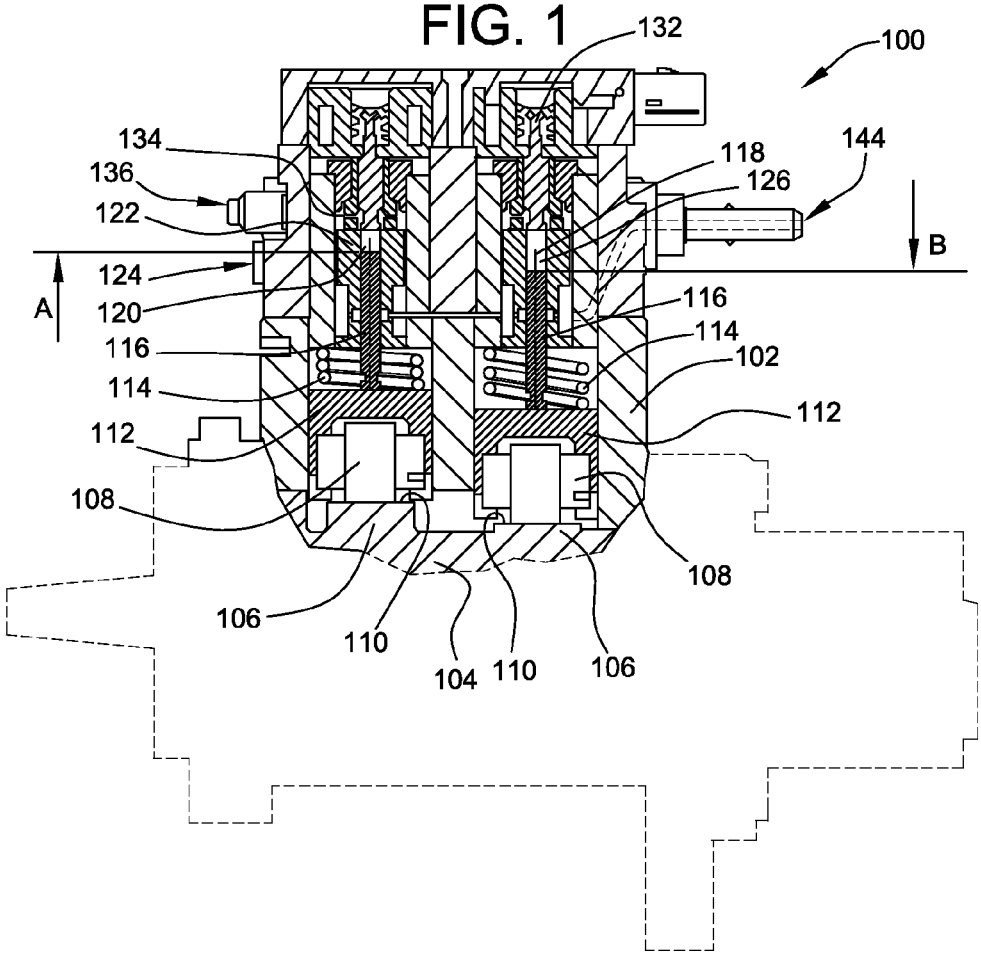
FIG. 1 is a partial cross section of a fluid pump having a plurality of pumping elements in accordance with the disclosure.
Figure 2:
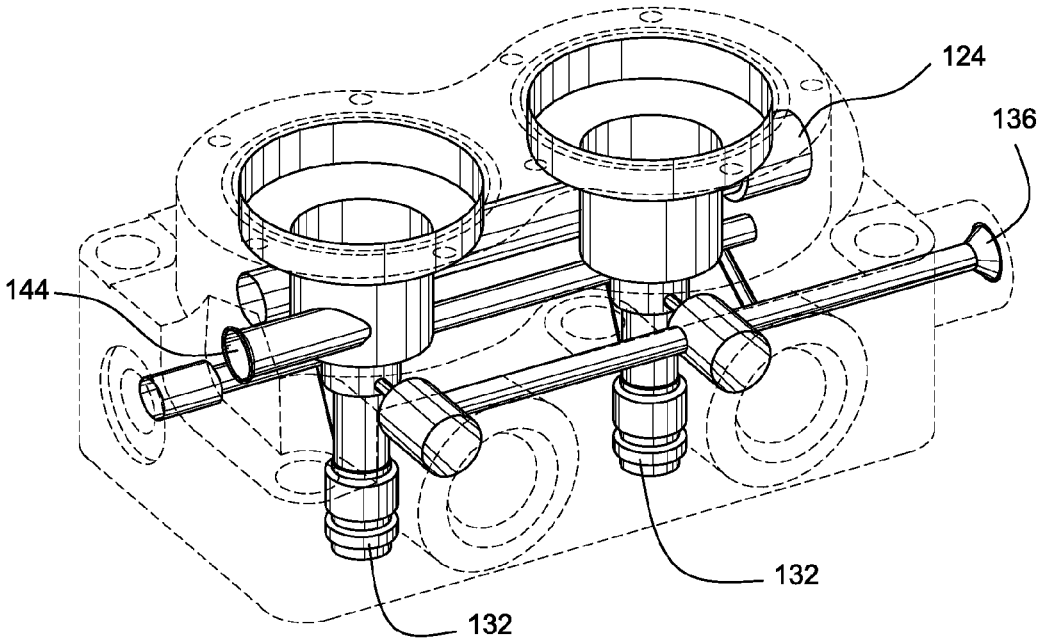
FIG. 2 is an internal view of a portion of the housing of the pump showing fluid passages defined therein.
Figure 3:
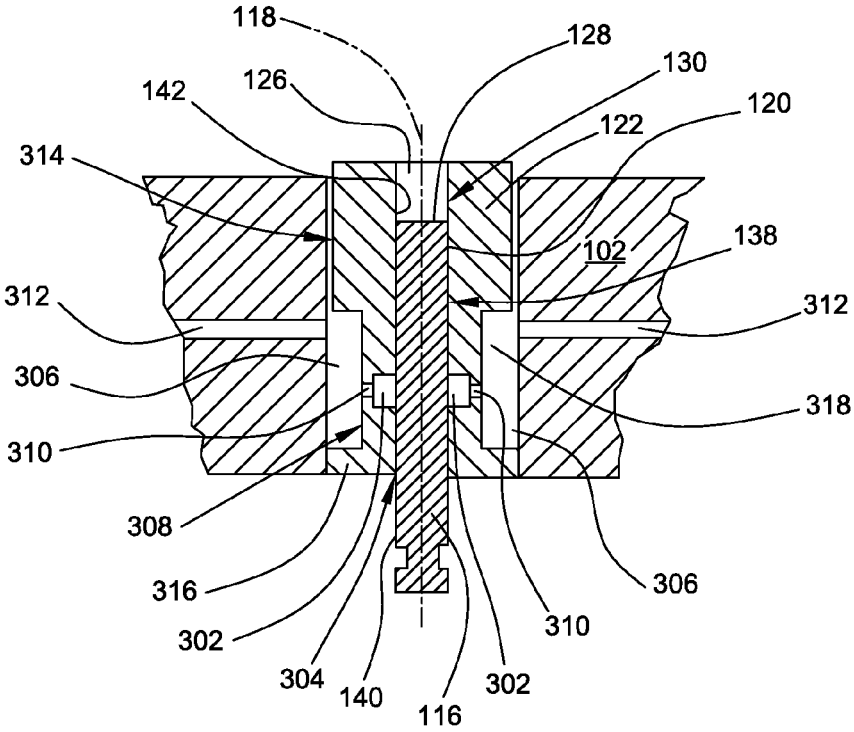
FIG. 3 is a cross section of a first embodiment for a pumping element in accordance with the disclosure.

Various views of a first embodiment for a fluid pump 100 in accordance with the disclosure are shown in FIG. 1 through FIG. 3. FIG. 1 is a partial cross section of the pump 100. An internal view of a portion of the housing of the pump showing fluid passages defined therein is shown in the enlarged detail of FIG. 2, and FIG. 3, is a cross section of a first embodiment for a pumping element. The pump 100 presented herein is arranged for pumping fuel into a common rail (not shown) that supplies pressurized fuel to one or more fuel injectors (not shown) during operation of an engine (not shown), and is used to illustrate the structure of the pumping elements by way of example. As can be appreciated, the structures described herein can advantageously be used on any type of fluid pump having a fixed or variable displacement.

The pump 100 uses oil for lubrication of various moving parts. Other types of pumps may use fuel for lubrication or, alternatively, be arranged to pump oil instead of fuel for use with intensified or hybrid fuel systems. The pump 100 described herein is presented solely for illustrative purposes and should not be construed as limiting.

The pump 100 includes a base or outer structure or housing, generally denoted in the figures as 102. The housing 102 may include one or more connected components forming a structure that encloses and supports various internal components of the pump. In this exemplary representation, the housing 102 includes a cam or drive shaft 104 having one or more eccentric lobes 106. Each lobe 106 corresponds to an actuator 108 that moves reciprocally along an outer race 110 of each lobe 106 as the shaft 104 rotates. Each actuator 108 contacts a lifter 112. The lifter 112 continuously contacts its respective outer race 110 by action of a resilient element or spring 114. The spring 114 pushes the lifter 112 against the actuator 108 to ensure that the reciprocating motion of the actuator 108 is transferred to the lifter 112 while the shaft 104 is rotating.

A plunger 116 is operatively connected to the lifter 112 such that the plunger 116 can reciprocate as the shaft 104 rotates. The plunger 116 has a cylindrical shape with a centerline 118 extending along its major dimension. During operation of the pump 100, the plunger 116 reciprocates along its centerline 118 within a bore 120 defined in a barrel 122. The barrel 122 has a generally cylindrical shape with the bore 120 extending through the barrel 122 along a central portion thereof. The bore 120 is arranged to have a centerline extending axially along the bore 120, substantially coincides with the centerline 118 of the plunger 116. During operation of the pump 100, the plunger 116 moves between an extended position, A, during a pressurization stroke, and a retracted position, B, during a filling stroke.

An inlet check valve (not shown) allows fuel from an inlet port 124 of the pump 100 to enter a pressurization chamber 126. The pressurization chamber 126 is at least partially defined between a distal end 128 of the plunger 116 (also see FIG. 2 and FIG. 3), a portion 130 of the bore 120, and an outlet check valve 132. Fuel present in the pressurization chamber 126 becomes pressurized while the plunger 116 moves from the retracted position B to the extended position A. Once the pressure of the fuel is sufficiently high, for example, between 30 and 3000 bar or more, the outlet check valve 132 opens to allow the pressurized fuel to exit the pressurization chamber 126 through one or more respective openings 134. Pressurized fuel exiting through each opening 134 is collected and routed to an outlet port 136 of the pump 100.

As can be appreciated, a proper clearance is required between the plunger 116 and the bore 120 that can seal the interface there between to promote proper pressurization of the fluid in the pressurization chamber 126, as well as accommodate for thermal expansion of the plunger 116 relative to the barrel 122. This annular clearance, generally shown as 138, is defined between an outer surface 140 of the plunger 116 and an inner surface 142 of the bore 120. Smaller clearances, which allow for greater efficiency for the pump 100, negatively affect the freedom of motion and thermal expansion of the plunger 116 within the bore 120. On the other hand, while larger clearances cause reductions in the efficiency of the pump.

Further, appreciable heating of the plunger 116 during operation of the pump 100 occurs due to heat transfer from the pressurized fluid within the pressurization chamber 126. A detailed cross section of a barrel 122 containing the plunger 116 is shown in FIG. 3. Fluid escaping from the pressurization chamber 126 during the pressurization stroke of the plunger 116 through the annular clearance 138 is collected in a collector 302. The collector 302 is an annular cavity that is formed in the barrel 122 around a portion of the bore 120. The collector 302 fluidly communicates with the pressurization chamber 126 through the annular clearance 138 such that fluid flowing or weeping along the plunger 116 within the annular clearance 138 is collected in the collector 302 and is not allowed to continue flowing along the plunger 116 to eventually seep out from an interface 304 between the barrel 122 and the plunger 116. Because the weeping fluid acts to heat the plunger in areas thereof it contacts, a temperature gradient is created in the plunger and barrel assembly above and below the collector 302.

The collector 302 is in fluid communication with an annular reservoir 306 that is defined by a reduced diameter portion 308 formed in the barrel 122. The collector 302 communicates with the annular reservoir 306 through one or more weep passages or holes 310 that are formed in the barrel 122 and that extend through the barrel 122 in a radial direction from the centerline 118. A plurality of weep holes 310 may be radially spaced about the circumference of the collector 302 to promote symmetrical outflow of fluid weeping along the annular clearance 138. The outflow of fluid from the weep holes 310 is collected in the annular reservoir 306 and is removed from the pump 100 via a drain passage 312 formed in the housing 102. The drain passage 312 fluidly communicates with a return port 144 that is defined in the housing 102 and that routes return or unused fluid back to a fluid tank or reservoir (not shown). Any number of annular reservoirs 306 may be formed in the housing 102 of pumps having more than one barrel 122. In such cases, various drain or intermediate passages 312 may connect each annular reservoir 306 with an adjacent passage or with the return port 144.

In the embodiment described thus far, the barrel 122 has a reduced outer diameter with respect to the outer diameter of a first surrounding portion 314 and a second surrounding portion 316 of the barrel 122. A channel 318 formed peripherally in the barrel 122 may define the reduced diameter portion 308. The channel 318 extends radially inward, toward the centerline 118 of the bore such that the thickness of material making up a wall of the barrel 122 is advantageously reduced in the reduced diameter portion 308. In the illustrated embodiment, the channel 318 is located proximate to the interface between the barrel 122 and the housing 102 that separates the fuel present in the channel 318 from lubrication oil that is used to lubricate the pump. As explained in detail below, the axial location of the channel 318 is chosen to optimize the thermal transfer attributes between the barrel 122 and the plunger 116.

As can be appreciated, a thermal gradient will be present in both the barrel 122 and plunger 116 during operation of the pump. This thermal gradient results from heating of the fuel being pressurized in the pressurization chamber 126, and due to leakage flow from the pressurization chamber 126, between outer plunger surface 140 and barrel inner bore surface 142, arriving in the collector 302. As the leakage flow progresses from the pumping chamber 126 to the collector 302, the potential energy of pressurization in the fluid is progressively converted into temperature rise in the fluid as the pressure drops from high to low levels.

Owing to the resultant higher temperatures of the fuel, heat is convectively transferred from the fuel to the portions of the barrel 122 and plunger 116 that surround the pressurization chamber 126, as well as the plunger outer surfaces 140 and barrel inner surfaces 142 located above collector 302. Heat also conductively travels through the components toward the fuel to oil interface of the pump. The thermal gradients may cause differing degrees of thermal expansion between the plunger 116 and the barrel 122, which may in turn cause dimensional clearance issues therebetween during operation of the pump.

These issues become relevant to the operation of the pump when present in the region that lies proximate to the fuel to oil interface and, more specifically, in the portion of the barrel 122 extending between the collector 302 and the fuel to oil interface. By locally reducing the mass of the barrel 122 in the area surrounding the collector 302, the thermal mass of the barrel 122 is reduced to equalize the temperature at the interface between the barrel 122 and the plunger 116 more rapidly. This structure may be particularly advantageous to equalize the barrel and plunger temperatures in transient operating conditions of the pump, while maintaining such equalization during steady state operation.

The barrel geometry, which in this case includes a reduction in material, finds special advantage when thermal issues are amplified during transient operation of the pump 100. For example, as pressurization of the fluid in each pressurization chamber 126 increases over relatively short durations, the plunger 116 begins to absorb increasing amounts of heat from the pumped fluid and leakage flow between plunger surface 140 and barrel bore surface 142. Moreover, the flow rate of fluid from the pressurization chamber 126 also increases thus augmenting the heat input to the plunger 116. The plunger 116, due in part to its comparatively low mass, and in part to its proximity or contact with the pumped fluid, and in part due to its relative lack of suitable conduction paths for escape of heat, is able to increase its temperature and trace the temperature of the pumped fluid relatively quickly, for example, within 1 to 2 minutes.

In contrast, a typical barrel having no channel and, thus, a larger mass, may require about 8 to 10 minutes to absorb sufficient heat to reach the temperature of the plunger temperature, especially during a transient. The reduced material or wall thickness of the barrel 122 in the reduced diameter portion 308 as described herein helps increase the temperature of the barrel 122 such that thermal expansion differences between the plunger 116 and the barrel 122 are reduced or eliminated faster, for example, within 4 to 6 minutes.

Figure 4:
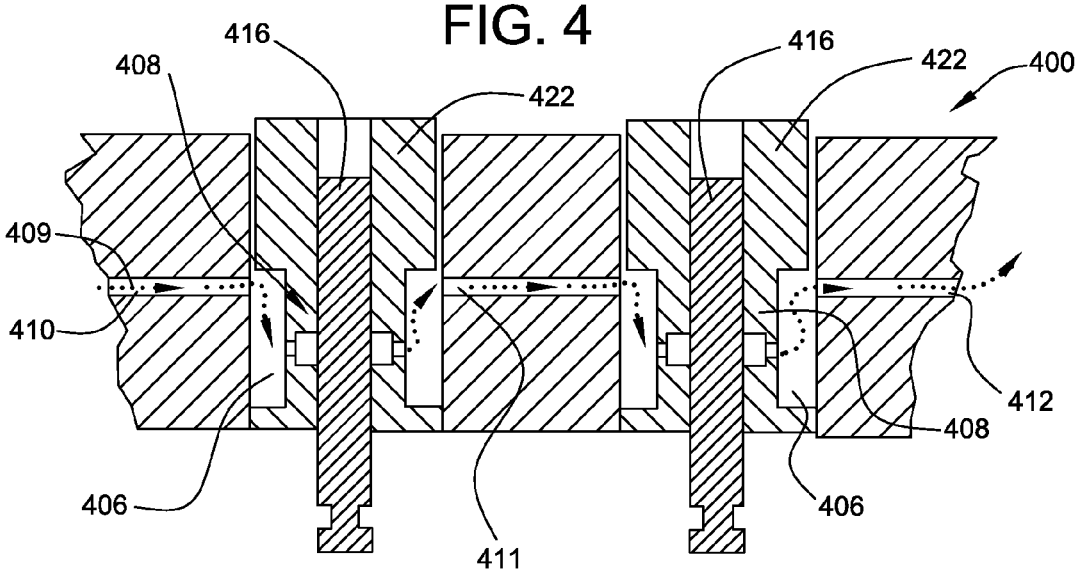
FIG. 4 is a cross section of a second embodiment for two adjacent pumping elements in accordance with the disclosure.

A cross section of two adjacent plungers 416 disposed in respective barrels 422 in a second embodiment of a fluid pump 400 is shown in FIG. 4. The barrels 422 of this embodiment are similar in structure to the barrels discussed in the first embodiment shown in FIG. 3. In the embodiment of FIG. 4, the reduced diameter portion 408 of each barrel 422 also acts to remove heat from the barrel 422 more efficiently so that the temperature of each plunger 416 is more readily reduced in the area above the weep holes 310 (FIG. 3). In this embodiment, a flow of cooled fluid 409, denoted generally by dotted-line arrows, is also supplied into each annular reservoir 406 via a cooled fluid supply passage 410. The flow entering the annular reservoir 406 surrounds the reduced diameter portion 408 of the barrel 422 and convectively cools the barrel 422. The heat removed from the barrel 422 in the area above the weep holes 310 (FIG. 3) serves to input heat to the remaining portion of the barrel 422 (in the area below the weep hole 310 as shown in FIG. 3), to help equalize the temperature of the barrel 422 and the plunger 416 along their respective lengths. Such temperature equalization, coupled with similarity in materials used to construct the barrel 422 and plunger 416, permits use of tighter clearances therebetween. In general, the heat outflow from the plunger 416 reduces the plunger's temperature, which eventually reduces or eliminates the temperature differentials between the plunger 416 and the barrel 422. The flow 409 may then sequentially enter adjacent annular reservoirs 406 via connecting passages 411 before exiting the pump 400 through one or more drain passage 412. In an alternate embodiment, the flow of cooled fluid 409 may be supplied in parallel circuit connection to all or more than one annular reservoirs 406 simultaneously.

Figure 5:
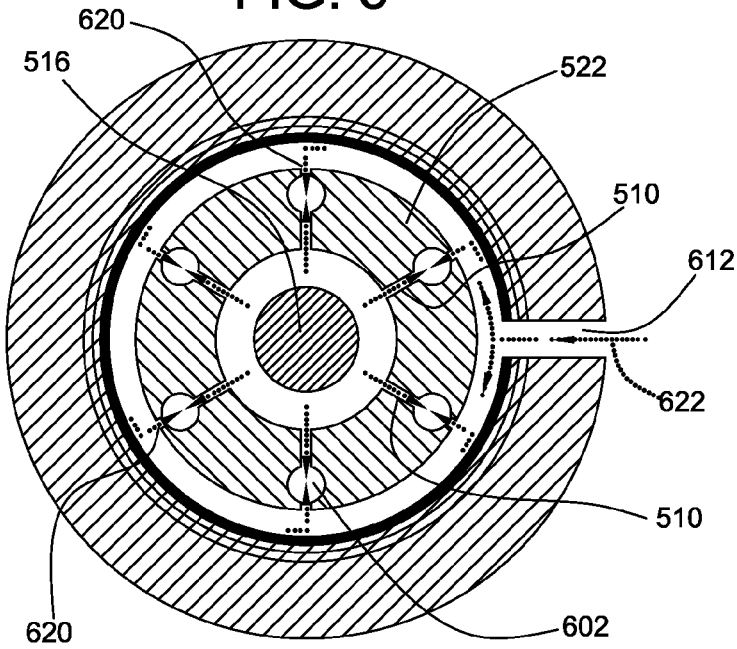
FIG. 5 is a cross section of a third embodiment for a pumping element in accordance with the disclosure.
Figure 6:
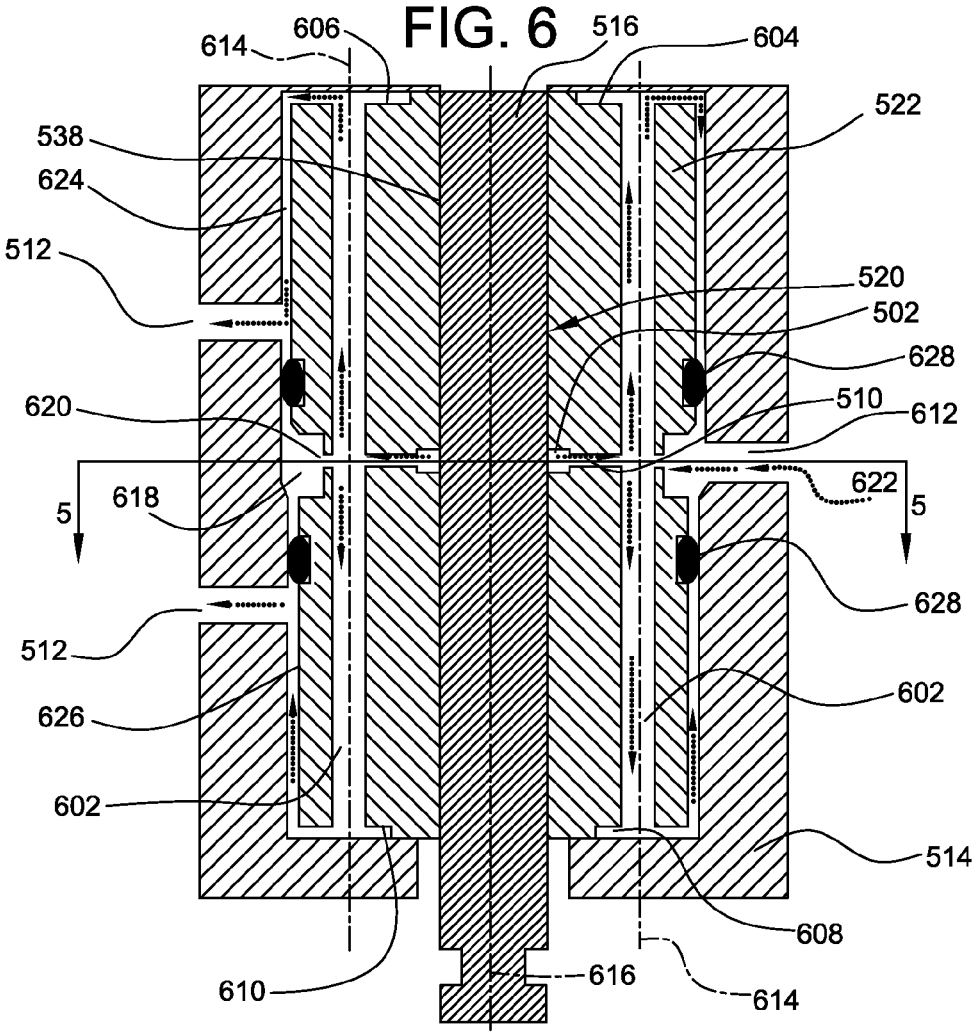
FIG. 6 is a different cross section of the third embodiment for a pumping element.

Two cross-sections of a third embodiment of a plunger 516 disposed within a barrel 522 are shown in FIG. 5 and FIG. 6. The barrel 522 defines a bore 520 that reciprocally accepts the plunger 516 and a collector 502 that surrounds a portion of the plunger 516. The collector 502 fluidly communicates with the annular clearance 538 between the outer surface of the plunger 516 and the inner surface of the bore 520. A plurality of weep openings 510 fluidly connect the collector 502 with two drain passages 512 that are defined in the surrounding pump housing 514. The weep openings 510 extend through the barrel 522 and intersect one or more longitudinal passages 602 formed in the barrel 522. Each longitudinal passage 602 extends through the barrel 522 and fluidly connects a first baffle 604, which may be formed on a first distal face 606 of the barrel 522, with a second baffle 608, which may be similarly formed on a second distal face 610 of the barrel 522. The first and second baffles 604 and 608 are annular cavities that fluidly connect the longitudinal passages 602 to each other as well as fluidly communicate with a cooling fluid inlet passage 612. Each longitudinal passage 602 extends along a centerline 614, which may be parallel to a centerline 616 of the bore 520. An annular reservoir 618 is formed around the barrel 522 and is fluidly connected to the weep openings 510 and the cooling fluid inlet passage 612.

A flow of cooling fluid 622, denoted by dotted-line arrows, enters the annular reservoir 618 through the cooling fluid inlet passage 612. The flow of cooling fluid 622 distributes around the barrel 522, within the annular reservoir 618, and enters each of the longitudinal passages 602 via the intermediate passages 620. Also during operation, a weep flow of fluid seeping through the annular clearance 538 collects in the collector 502 and enters each of the longitudinal passages 602 via the weep openings 510. The weep flow exiting the collector 502 through the weep openings 510 mixes with the flow of cooling fluid from the intermediate passages 620 and then splits into various portions that flow through the longitudinal passages 602. The mixed flows follow the longitudinal passages 602 toward the first baffle 604, pass through the first baffle 604 and into a first outer collector 624, and exit through one of the two drain passages 512. In a similar fashion, the mixed flows follow the longitudinal passages 602 toward the second baffle 608, pass through the second baffle 608 and into a second outer collector 626, and exit through the other one of the two drain passages 512. Two seals 628 are located between the barrel 522 and the housing 514. The seals 628 inhibit a direct fluid path between the cooling fluid inlet passage 612 and the two drain passages 512 that would bypass the longitudinal passages 602. As a result, the flow of cooling fluid 622 is forced to follow a tortuous path through the barrel 522 to promote cooling.

Figure 8:
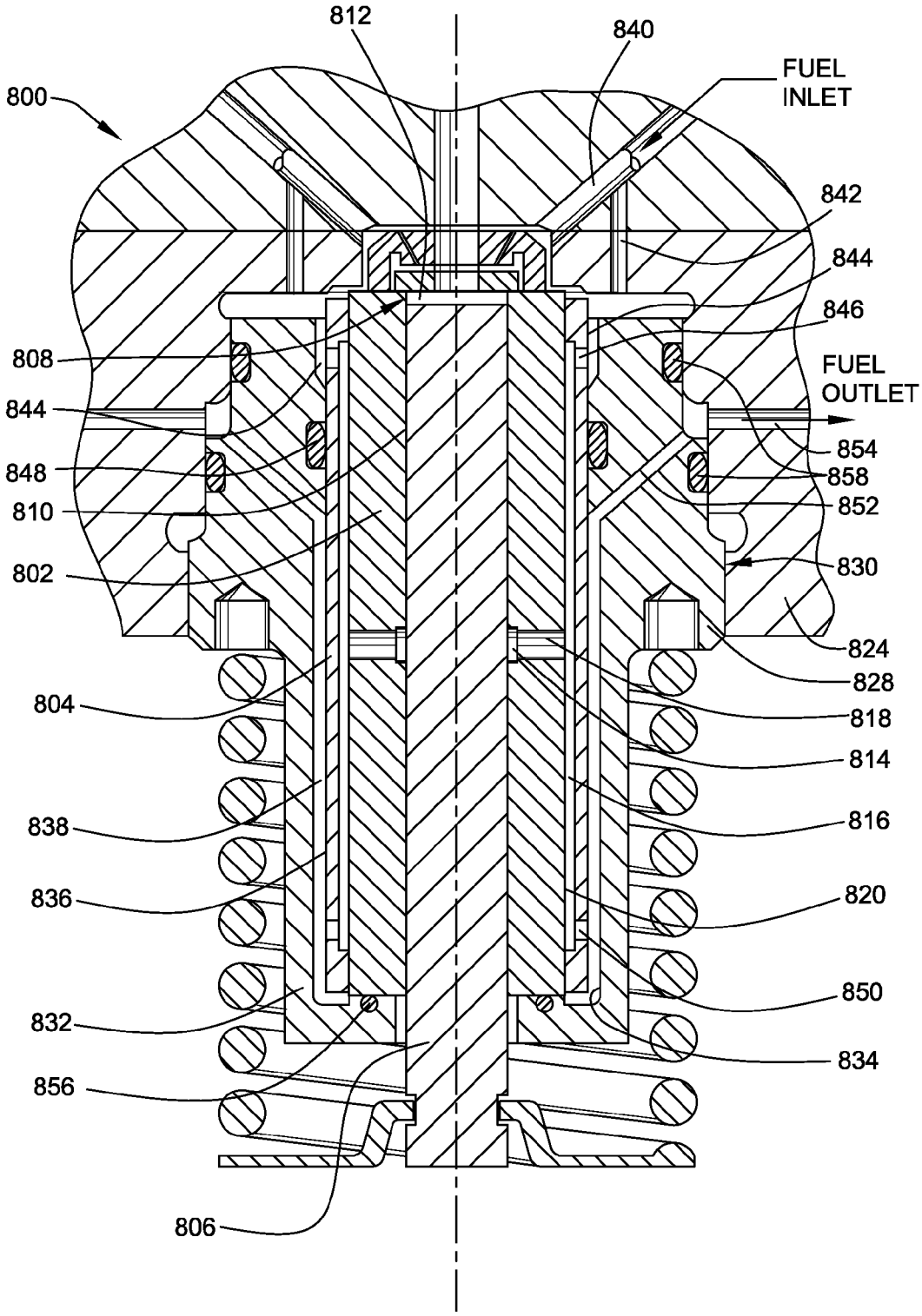
FIG. 8 is a cross section of a fourth embodiment for a pumping element in accordance with the disclosure.

A cross section of a fourth embodiment of the present disclosure is shown in FIG. 8. The barrel assembly 800 includes a generally cylindrical barrel 802 positioned within a sleeve 804, sized to matingly engage with the exterior surface of the barrel 802 proximate to the ends of the barrel 802. The barrel 802 and sleeve 804 may advantageously be used in place of the barrels described in accordance with the first three embodiments. A plunger 806 is positioned within a bore 808 formed in the barrel 802 portion of the barrel assembly 800. An annular clearance 810 between the plunger 806 and the barrel 802 fluidly connects a pressurization volume 812 with a collector 814. The collector 814 extends peripherally around at least a portion of the plunger 806 and is axially positioned adjacent to the midpoint of the barrel 802. The collector 814 fluidly communicates with an inner annular reservoir 816 via a plurality of weep openings 818. The inner annular reservoir 816 is defined within a channel 820 formed internal to the sleeve 804. The channel 820 extends between an outer portion of the barrel 802, the inner portion of the sleeve 804, and two channel walls 822 defined axially on both ends of the sleeve 804. Each wall 822 extends between the barrel 802 and sleeve 804 to define and sealably enclose the inner annular reservoir 816.

The barrel assembly 800 is connected to the pump housing 824 via an adapter 826. The adapter 826 forms a mounting portion 828 for attachment into a cavity 830 formed in the pump housing 824 and a retaining portion 832 for sealably engaging and supporting the barrel assembly 800. The adapter 826 forms a receiving bore 834 extending through the mounting portion 828 and the retaining portion 832. The receiving bore 834 is arranged to house the barrel assembly 800. The adapter 826 also forms an internal channel 836 along a portion of the receiving bore 834 that lies along the retaining portion 832. The internal channel 836 at least partially defines an outer annular reservoir 838 when the barrel assembly 800 is installed into the receiving bore 834.

In the embodiment shown, the pump housing 824 forms a fluid supply passage 840 extending therethrough. The fluid supply passage 840 may be fluidly connected to a fuel transfer pump and/or fuel cooler (not shown) and may be arranged to supply fuel at a low pressure to the pressurization volume 812 during the refill stroke of the plunger 806. A branch passage 842 may connect the fluid supply passage 840 with an annular conduit 844 formed in the mounting portion 828 of the adapter 826 surrounding a distal end of the sleeve 804 adjacent the pressurization volume 812.

A seal 848 fluidly separates the annular conduit 844 from the internal channel 836 in the adapter 826. An inlet opening 846, which is defined in the sleeve 804, fluidly connects the annular conduit 844 with the inner annular reservoir 816. Similarly, an outlet opening 850 defined in the sleeve 804 fluidly connects the inner annular reservoir 816 with the outer annular reservoir 838. The outer annular reservoir 838 is fluidly connected to a fluid return passage 854 of the housing 824 via an outlet passage 852 defined in the adapter 826. Fluid present within the outer annular reservoir 838 is sealed from directly reaching the plunger 806 by a second seal 856 disposed between the barrel 802 and the adapter 826. Further, two additional seals 858 fluidly isolate the outlet passage 852 as it passes through the interface between the adapter 826 and the housing 824.

During operation, unpressurized fluid present in the fluid supply passage 840 freely circulates around the barrel 802 and provides temperature equalization along the length of the barrel 802 and plunger 806 as described above. The fluid may follow a cooling path that originates at the fluid supply passage 840, passes through the branch passage 842 into the annular conduit 844, and enters the inner annular reservoir 816 via the inlet opening 846 of the sleeve 804. While in the inner annular reservoir 816, the flow wets a substantial portion of the outer surface of the barrel 802 and convectively cools the barrel 802 along a segment thereof that is above (as shown) the collector 814. The inner annular reservoir 816 of this embodiment has a similar function to the longitudinal channels described above inasmuch as the flow passing through the inner annular reservoir 816 cools the barrel 802 and mixes with the heated fluid weeping from the collector 814. The flow carries the heated fluid away from the barrel 802 as the flow exits the inner annular reservoir 816 through the outlet opening 850 of the sleeve 804. The flow passing through the outlet opening 850 is collected in the outer annular reservoir 838 before passing to the outlet passage 852 and out the fluid return passage 854 of the housing 824. By circulation of fluid in the manner described, heat can efficiently be removed from the barrel 802 during operation. Moreover, the thermal mass of the fluid present in the inner and outer annular reservoirs helps stabilize and equalize the temperatures of the plunger 806, the barrel 802, the sleeve 804, and the adapter 826 within a relatively short duration.

Figure 9:
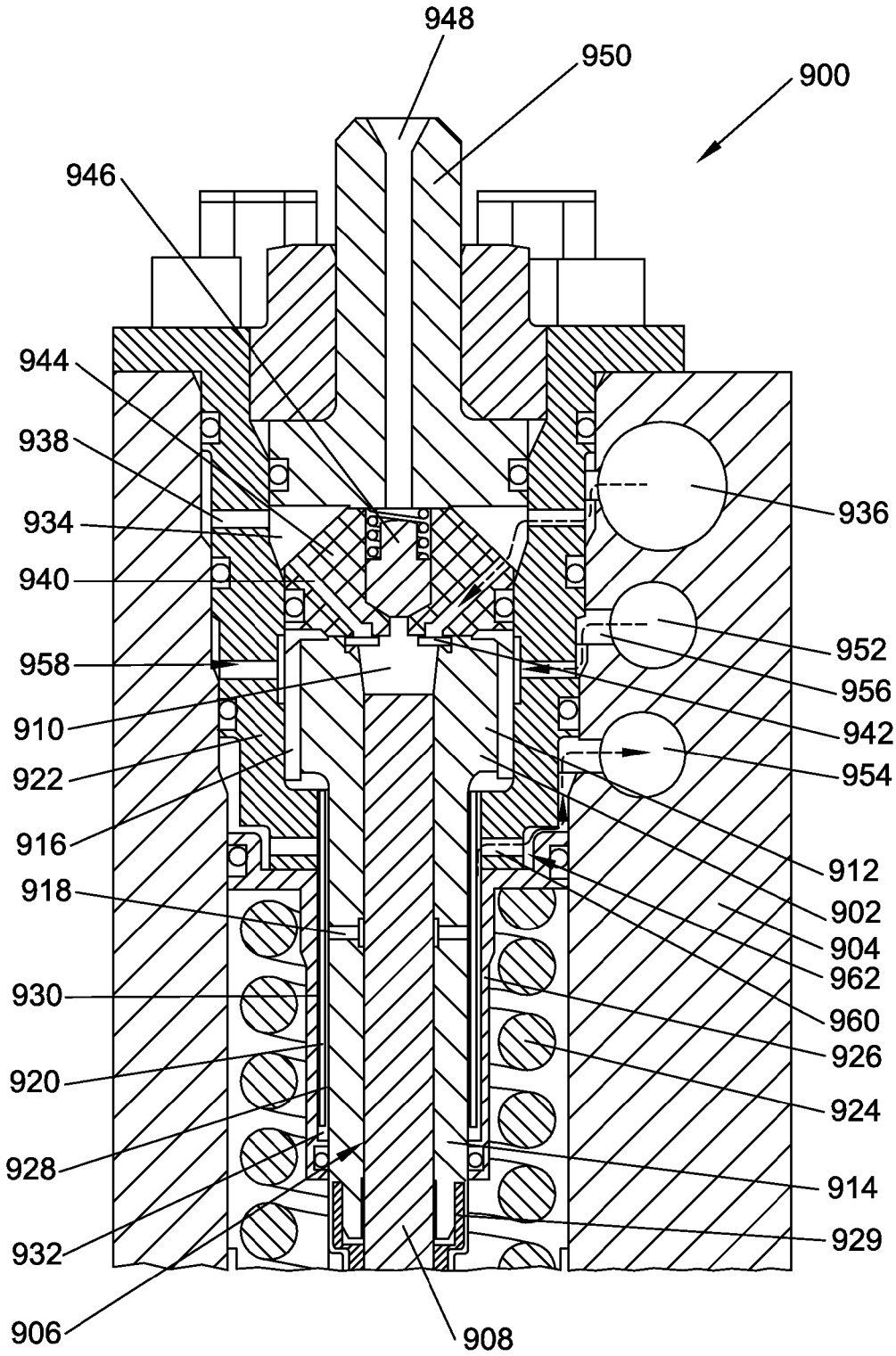
FIG. 9 is a partial cross section of a fifth embodiment for a pumping element in accordance with the disclosure.

A cross section of a fifth embodiment of a pumping element 900 is shown in FIG. 9. In this embodiment, a generally cylindrical pump barrel 902 is shown assembled into a fuel pump housing 904, which is partially shown to illustrate various fluid passages that are formed therein. The pump barrel 902 forms a barrel bore 906 that slidingly but generally sealably receives a plunger 908. As discussed relative to the previous embodiments, the plunger 908 is arranged to reciprocate within the barrel bore 906 during operation of the fuel pump housing 904 such that the volume of a compression chamber 910 changes to compress fuel found therein.

In this embodiment, the pump barrel 902 includes a head portion 912 and a body portion 914. As illustrated in FIG. 9, an outer diameter of the head portion 912 is larger than the outer diameter of the body portion 914. A plurality of flow channels 916 is formed in the head portion 912 of the pump barrel 902. Such flow channels 916 are optional and can extend along a major longitudinal dimension of the pump barrel 902. The flow channels 916 may be arranged symmetrically around the head portion 912 at various radial locations. As shown, four such flow channels 916 are formed in the head portion 912. The pump barrel 902 further forms at least two weep openings 918 that fluidly interconnect the barrel bore 906 with an external surface of the body portion 914. The weep openings 918 can be used to channel fuel leaking from the compression chamber 910 along an interface between the barrel bore 906 and the plunger 908 during operation.

In a fashion similar to the embodiment illustrated in FIG. 8, the pump barrel 902 is positioned within a sleeve 920. The sleeve 920 is generally cylindrical and disposed around a major segment of the body portion 914. The sleeve 920 is connected to an adapter 922, which is an intermediate component that sealably engages the pump housing 904 at various locations thereof, and further engages and supports the pump barrel 902 and the sleeve 920 as previously described relative to the embodiment illustrated in FIG. 8. The sleeve 920 is connected at one end thereof to the adapter 922 and extends, in a cantilever fashion, concentrically along the body portion 914 of the pump barrel 902, as shown in FIG. 9. When the pumping element 900 is assembled within the fuel pump housing 904, a spring 924 urges the plunger 908 to remain in contact with a cam follower (not shown) such that reciprocal motion of the plunger 908 may be achieved. The spring 924 operates in an environment having lubrication oil present. A retainer 926 is disposed between the adapter 922 and the spring 924 to retain the spring 924 in position and to seal the pump barrel 902 and sleeve 920 from lubrication oil.

The retainer 926 sealably engages the pump housing 904 and extends concentrically along the body portion 914 of the pump barrel 902. Further, the retainer 926 sealably engages the pump barrel 902 adjacent the end of the body portion 914. A compound seal arrangement 929 sealably and slidably engages the plunger 908, and sealably engages an end of the body portion 914. One can appreciate that other sealing arrangements may be used to fluidly isolate the pump barrel 902 from cavities containing other fluids, for example, lubrication oil found in the cam or driving portions of a pump.

In this embodiment, an inner annular reservoir 928 is defined between the pump barrel 902 and the sleeve 920, and an outer annular reservoir 930 is defined between the sleeve 920 and an inner surface of the retainer 926. The inner annular reservoir 928 and outer annular reservoir 930 are fluidly interconnected by an opening or gap 932 that extends across the sleeve 920. In one embodiment, the gap 932 can be an opening formed in the sleeve 920. In the illustrated embodiment, the gap 932 results from a length difference between the sleeve 920 and the inner surface of the retainer 926 close to an end thereof, as shown.

During operation of the pumping element 900, low pressure fuel is supplied to an inlet volume 934 defined within the adapter 922. Such fuel is provided by a supply passage 936 formed in the pump housing 904, which is fluidly connected to the inlet volume 934 by one or more supply openings 938 formed in the adapter 922. When the plunger 908 is undergoing an intake stroke, i.e. when the plunger 908 retracts within the barrel bore 906 increasing the volume of the compression chamber 910, fuel enters the compression chamber 910 from the inlet volume 934 via two or more supply passages 940 and an inlet check valve 942. In the illustrated embodiment, the two or more supply passages 940 are formed in a header piece 944, which also houses an outlet check valve 946. When the plunger 908 undergoes a compression stroke, which reduces the volume of the compression chamber 910, pressurized fuel passes through the outlet check valve 946 and enters a high pressure passage 948 formed in a high pressure outlet port 950.

As in the previous embodiments, a flow of fuel to cool the pump barrel 902 is provided. In the illustrated embodiment, the pump housing 904 forms a cooling fuel supply passage 952 and a fuel return passage 954. The cooling fuel supply passage 952 may be a separate passage or it may be fluidly connected to a source of fuel that also supplies fuel to the supply passage 936. Moreover, the fuel return passage 954 may be a passage dedicated to routing fuel used for cooling the pumping element 900, or may alternatively be in fluid communication with a fuel drain passage of the fuel pump, as is the case in the embodiment illustrated.

During operation of the pump, a flow of cooling fuel is provided to the pump via the cooling fuel supply passage 952. Such flow may be part of a main fuel flow to the pump that is compressed and provided to the fuel injectors (see, for example, the illustration of FIG. 7), or may alternatively be provided as part of a separate cooling circuit that includes a fuel cooler or other devices. In embodiments for fuel pumps that include more than one pumping elements, the flow of cooling fuel may sequentially pass through each pumping element in series, as is illustrated in FIG. 4, or may alternatively by provided to all pumping elements in a parallel circuit configuration.

In the embodiment illustrated, a portion of the cooling fuel flow at the cooling fuel supply passage 952 enters an internal portion of the adapter 922 via a supply passage 956 formed in the pump housing 904, and then via a supply opening 958 formed in the adapter 922. One can appreciate that more than one supply passage or opening may be used. The flow of fuel through the various components and portions of the pump illustrated in FIG. 9 is denoted by dashed-line arrows for clarity.

The flow of cooling fuel entering the adapter 922 via the supply opening 958 passes through the flow channels 916 and enters the inner annular reservoir 928. In this embodiment, the sleeve 920 acts as a baffle that directs the flow of cooling fluid entering the inner annular reservoir 928 along almost the entire length of the body portion 914 of the pump barrel 902. One can appreciate that heat is convectively removed from the pump barrel 902 as the flow of cooling fuel travels along the body portion 914. The flow of cooling fuel in the inner annular reservoir 928 passes into the outer annular reservoir 930 via the opening or gap 932. While in the outer annular reservoir, the flow of cooling fuel travels back toward the adapter 922. When the flow of cooling fuel reaches the adapter 922, the flow passes through a portion of the adapter 922 via an outlet opening 960 to enter a drain volume 962. The flow entering the drain volume 962 may also include fuel provided via the weep openings 918 as previously described. The drain volume 962 is fluidly connected to the fuel return passage 954, which may be a low pressure return passage to a tank or reservoir (see, for example, the LP Fuel return line connected to the return outlet port 712 of the HP pump 702 in FIG. 7).

Figure 10:
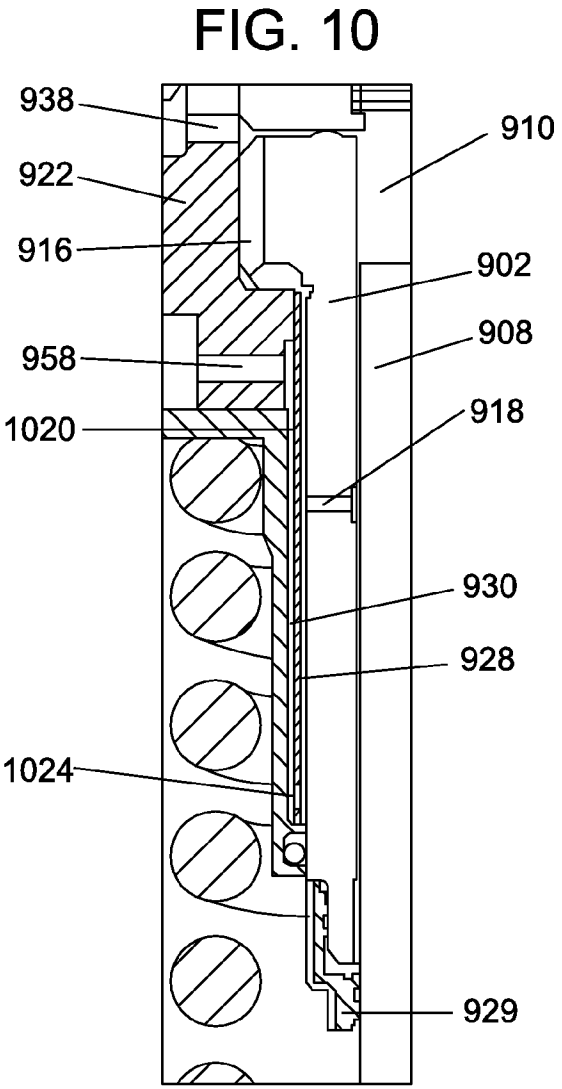
FIG. 10 is a detail view of the cross section illustrated in FIG. 9.

A partial cross section detail of an alternative embodiment to the embodiment illustrated in FIG. 9 is shown in FIG. 10. In this alternative embodiment, components or features that are the same or similar to components or features previously described are denoted by the same reference numerals for simplicity. In this alternative embodiment, the pump barrel 902 is disposed within the adapter 922. The adapter supports a sleeve 1020 concentrically around the pump barrel 902. The sleeve 1020, unlike the sleeve 920 illustrated in FIG. 9, extends along an entire length of an inner surface 1022 of the retainer 926. Stated differently, an end of the sleeve 1020 abuts against a surface of the retainer 926 such that there is no gap or opening, such as the gap 932 illustrated in FIG. 9. In the embodiment illustrated in FIG. 10, the sleeve forms one or more openings 1024 that fluidly connect the inner annular reservoir 928 with the outer annular reservoir 930 that are defined between the pump barrel 902, the sleeve 1020, and the retainer 926 as previously described.

Figure 11:
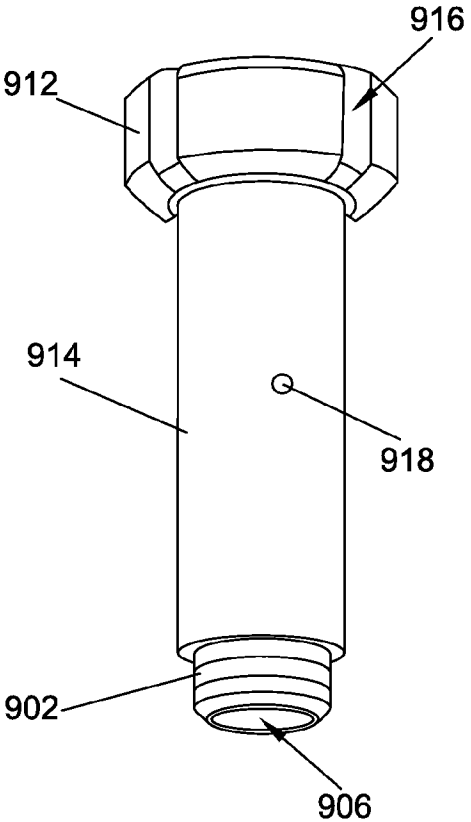
FIG. 11 is an outline view of a barrel for the pumping element illustrated in FIG. 9.
Figure 12:
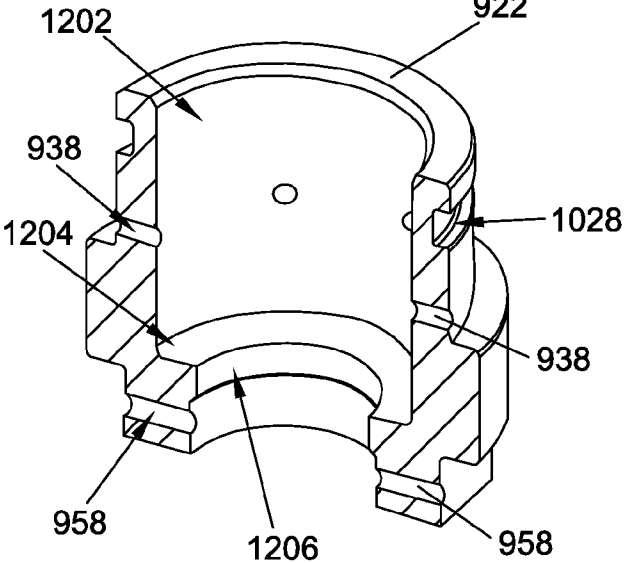
FIG. 12 is a cross section of a component having passages formed therein in accordance with the disclosure.

An outline view of the pump barrel 902 is shown in FIG. 11, and an outline view of the adapter 922 is shown in FIG. 12 in cross section, for illustration of the various features thereof. As illustrated in FIG. 11 and FIG. 12, each of the plurality of flow channels 916 formed in the head portion 912 of the pump barrel 902 extends along both an outermost surface 1102 thereof as well as a radially extending surface 1104. The radially extending surface 1104 may include chamfers or other surface features and extends between the larger, outer diameter of the head portion 912 and the inner, smaller outer diameter of the body portion 914 as shown. In this manner, portions of the flow of cooling fuel passing through the plurality of flow channels 916 may be maintained in continuous contact with the pump barrel 902, to optimize cooling, and may be routed more efficiently into the inner annular reservoir 928 (as shown in FIGS. 8-10).

Turning now to the cross section of the adapter 922 shown in FIG. 12, the adapter 922 includes an inner bore 1202 forming a shoulder 1204. The shoulder 1204 contacts and supports the head portion 912 of the pump barrel 902 when assembled. In the illustrated embodiment, an inner diameter 1206 of the adapter 922 is arranged to have an interference fit with an outer diameter of the sleeve 920 (FIG. 9) or the sleeve 1020 (FIG. 10) to provide support thereto and to locate it concentrically around the body portion 914 of the pump barrel 902 passing therethrough. As can be seen in the various views of the drawings, sealing between different portions of the adapter 922 can be accomplished by o-ring seals disposed in sealing grooves, for example, a sealing groove 1028, in sealing relationship with the pump housing 904.

INDUSTRIAL APPLICABILITY

The present disclosure is applicable to a fluid pump having one or more reciprocating plungers that can pressurize a fluid to levels that were previously unattainable by use of known pumping systems. The embodiments disclosed herein are advantageously suited for implementation in fluid pumps that are capable of prolonged and reliable operation under high-pressure transient and steady-state conditions. Pumps in accordance with the disclosure are advantageously capable of achieving outlet pressures in the range of 1800 to 3000 bar or higher. This advantageous operation is enabled because of the improved management of heat transferred between the pumping elements.

In one aspect, the disclosure provides a method of mixing cooling flow with heated leakage flow. The mixed flow can be routed around and then away from the pumping element to provide for uniform temperature control of the plunger and barrel. Such uniform control may advantageously result in matching the thermal expansions for the plunger and barrel, as well as provide cooling of the plunger and barrel. In this fashion, the resulting operational clearance between the plunger and barrel may never reach zero under all steady state and transient operating conditions. In one embodiment, a pump having about 12 microns of clearance and operating at about 190 MPa, may be redesigned in accordance with the present disclosure to have about 5-6 microns of clearance and be capable of operating at higher pressures, for example, at 300 MPa.

Moreover, active cooling of elements, for example as shown for the second and third embodiments, can further aid in lowering the overall temperatures of the plunger, barrel, and other components of the pump. Further, reduction of the overall mass of the barrels of the three embodiments presented lowers the thermal capacity of each barrel such that the temperature of the barrel tracks the temperature of the plunger, which is especially useful during transient changes in the operation of the pump.

Figure 7:
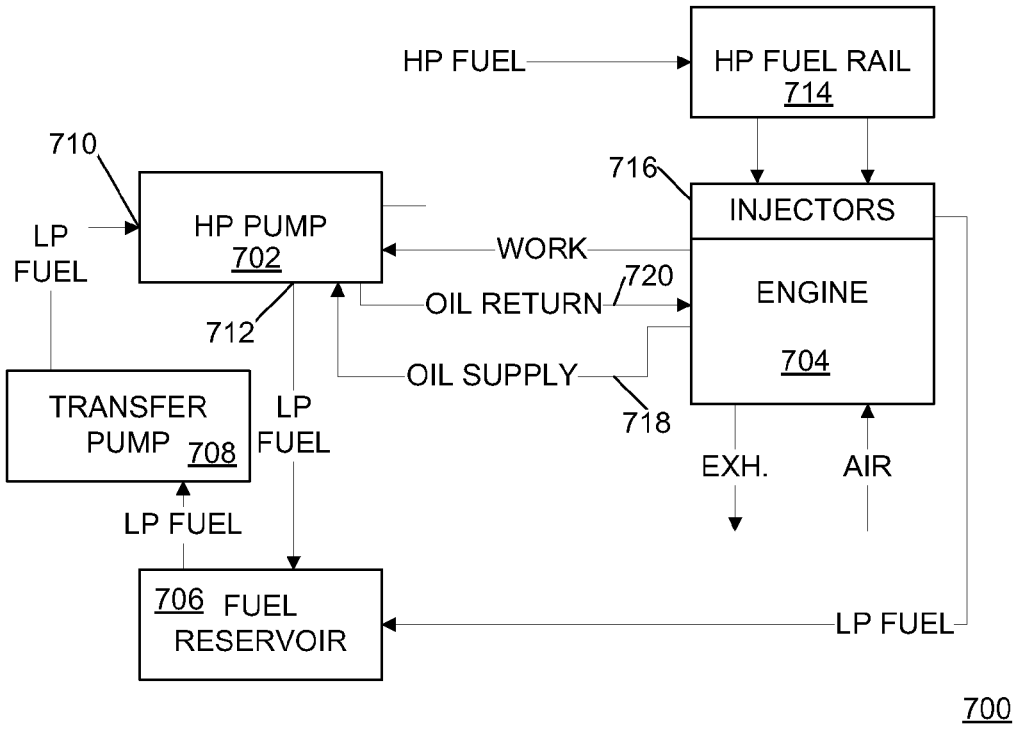
FIG. 7 is a block diagram of an engine system having a high-pressure fuel pump associated therewith in accordance with the disclosure.

A block diagram for an engine system 700 having a high-pressure (HP) fuel pump 702 operatively associated therewith is shown in FIG. 7. The engine system 700 includes an internal combustion engine 704 connected with the HP pump 702. The engine 704 may be a compression ignition or diesel engine that receives air and fuel into a plurality of combustion chambers during operation. Fuel at a low-pressure (LP) is supplied to the HP pump 702 from a tank or reservoir 706. The reservoir 706 is connected to a transfer or low-pressure pump 708 that operates to pump fuel out of the reservoir 706 and supply the fuel to the HP pump 702 through the supply inlet port 710 thereof. The return outlet port 712 of the HP pump 702 is connected to the reservoir 706 such that LP fuel exiting the HP pump 702, for example, fuel exiting the annular reservoir(s) of the HP pump 702 as described above, returns to the reservoir 706.

During operation of the engine 704, a work output from the engine 704 operates the HP pump 702. A flow of pressurized fuel (HP Fuel) exits the HP pump 702 and is delivered to the engine 704. For example, the flow of HP fuel may be delivered to a HP fuel rail 714 that is connected to a plurality of fuel injectors 716, which are integrated with the engine 704. A flow of unused fuel from the fuel injectors 716 may return to the reservoir 706. In this exemplary illustration, the HP pump 702 uses lubrication oil from the engine 704 for lubrication of internal moving components, such as, the actuators and lifters (not shown) that contact the drive shaft (not shown) of the HP pump 702. For this purpose, an oil supply line 718 acts in conjunction with an oil return line 720 to circulate a flow of lubrication oil between the engine 704 and the HP pump 702. As can be appreciated, the engine system 700 as described herein is suited for use in a vehicle having the engine 704 arranged to drive and power various systems on the vehicle.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A pumping element for pressurizing a fluid within a fluid pump, comprising:

a fuel pump housing disposed around the pumping element;

a plunger reciprocally disposed within a bore defined in a barrel, the plunger and the barrel at least partially defining a pressurization chamber into which fluid is pressurized;

a flow path defined between the plunger and the bore, the flow path permitting fluid to pass from the pressurization chamber during pressurization of fluid disposed therein;

a collection chamber formed between the plunger and the bore, the collection chamber disposed adjacent to the bore;

at least one weep opening defined in the barrel, the at least one weep opening being fluidly connected to the collection chamber; and an annular reservoir defined between the barrel and the fuel pump housing, the annular reservoir disposed to receive fluid via the at least one weep opening.

2. The pumping element of claim 1, wherein the annular reservoir is formed in the barrel.

3. The pumping element of claim 1, wherein the annular reservoir is formed in the fuel pump housing.

4. The pumping element of claim 1, further including:

a plurality of longitudinal passages defined in the barrel, the plurality of longitudinal passages extending parallel to the bore and arranged symmetrically around the bore; and a plurality of intermediate passages, each intermediate passage fluidly connecting each of the plurality of longitudinal passages with the annular reservoir.

5. The pumping element of claim 4, further including a baffle defined in the barrel, the baffle extending along a portion of a distal face of the barrel, the baffle fluidly connecting the plurality of longitudinal passages with each other.

6. The pumping element of claim 1, wherein the annular reservoir is at least partially defined by a channel, the channel formed peripherally around a reduced diameter portion of the barrel and extending radially inward toward the bore.

7. The pumping element of claim 6, wherein the reduced diameter portion extends between an end of the barrel and a head portion of the barrel, the reduced diameter portion defining a body portion of the barrel.

8. The pumping element of claim 7, further including a sleeve and an adapter that engages the barrel, the sleeve having a generally cylindrical shape, being disposed concentrically around the body portion of the barrel, and being connected to the adapter.

9. The pumping element of claim 8, wherein an inner annular reservoir is defined between the body portion and the sleeve.

10. The pumping element of claim 9, further including a retainer disposed around the sleeve and at least the body portion of the barrel.

11. The pumping element of claim 10, wherein the retainer forms an inner cylindrical surface disposed concentrically around the sleeve.

12. The pumping element of claim 11, wherein an outer annular reservoir is at least partially defined between the sleeve and the inner cylindrical surface of the retainer.

13. The pumping element of claim 12, further including a gap defined between the retainer and an end of the sleeve, the gap fluidly connecting the inner annular reservoir with the outer annular reservoir.

14. The pumping element of claim 13, wherein the inner annular reservoir is fluidly connected with a supply passage providing a flow of cooling fluid, and wherein the supply passage is formed in the fuel pump housing.

15. The pumping element of claim 14, wherein the head portion of the barrel forms a plurality of flow channels extending along a major longitudinal direction of the barrel and disposed symmetrically around the barrel at various radial locations relative to centerline of the barrel to fluidly interconnect the supply passage with the inner annular reservoir.

16. The pumping element of claim 14, wherein the adapter forms an inlet opening that is adapted to fluidly interconnect the supply passage with the inner annular reservoir.

17. The pumping element of claim 16, wherein the adapter forms an outlet opening that fluidly connects the outer annular reservoir with a return passage formed in the fuel pump housing.

18. A fuel pump for an internal combustion engine, the fuel pump having a housing forming an inlet port, an outlet port, and a return port, the fuel pump operating to pump fuel from the inlet port to the outlet port, the fuel pump comprising:

a cooling fuel inlet port formed in the housing, a cooling fuel supply passage formed in the housing in fluid communication with the cooling fuel inlet port;

a barrel disposed within the housing, the barrel defining a bore extending through the barrel and having a centerline;

a plunger at least partially disposed within the bore, the plunger arranged for reciprocal motion within the bore;

a pressurization cavity at least partially defined between an end of the plunger and an end portion of the bore, the pressurization cavity adapted for pressurizing an amount of fuel supplied through the inlet port and provided to the outlet port;

an annular clearance defined between an outer surface of the plunger and an inner surface of the bore, the annular clearance in fluid communication with the pressurization cavity;

an annular collector defined around the inner surface of the bore, the annular collector surrounding a portion of the plunger, the annular collector being in fluid communication with the annular clearance;

an annular reservoir defined peripherally around the barrel and between the barrel and the housing, the annular reservoir being in fluid communication with the return port;

at least one weep opening formed in the barrel, the at least one weep opening fluidly connecting the annular collector with the annular reservoir;

wherein the annular reservoir is in fluid communication with the cooling fuel supply passage.

19. The fuel pump of claim 18, wherein the annular reservoir is formed in at least one of the barrel and the housing.

20. The fuel pump of claim 18, wherein the annular reservoir is defined at least partially within a channel formed in the barrel, the channel extending radially inwards toward the centerline of the bore over a longitudinal length of the barrel extending between and end of the barrel and a head portion of the barrel.

21. The fuel pump of claim 18, further including a generally cylindrical sleeve disposed around at least a portion of the barrel and separating the annular reservoir into an inner annular reservoir, which is defined between the barrel and the generally cylindrical sleeve, and an outer annular reservoir.

22. The fuel pump of claim 21, wherein the inner annular reservoir is in fluid communication with the outer annular reservoir, the cooling fuel supply passage, and the at least one weep opening, and wherein the outer annular reservoir is in fluid communication with the return port.

23. The fuel pump of claim 21, wherein a path for a flow of fuel begins from the cooling fuel supply passage, terminates at a return passage, and extends through the inner annular reservoir and the outer annular reservoir.

24. A method of operating a fluid pump at a high pressure, the fluid pump including a barrel having a bore extending therethrough, the bore reciprocally accepting a plunger, the reciprocating motion of the plunger including a pressurization stroke and a refill stroke, the plunger moving toward the barrel during the pressurization stroke, the method comprising:

admitting fluid into a pressurization chamber during the refill stroke, the pressurization chamber at least partially defined between the plunger and the bore;

pressurizing the fluid during the pressurization stroke;

flowing fluid out of the pressurization chamber and along a clearance between the plunger and the bore;

collecting the fluid flowing along the clearance into a collection chamber, the collection chamber defined in the barrel around a portion of the plunger adjacent to the bore;

routing a flow of fluid out of the collection chamber through at least one weep opening;

collecting the flow of fluid from the at least one weep opening into an annular reservoir, the annular reservoir defined peripherally around a portion of the barrel; and supplying a flow of cooling fluid into the annular reservoir;

mixing the flow of cooling fluid with the flow of fluid from the collection chamber to form a mixture in the annular reservoir; and conducting heat away from the plunger by removing the mixture from the annular reservoir.

25. The method of claim 24, further including actively cooling the barrel convectively with the flow of cooling fluid.

* * * * *